US012773608B2

(12) United States Patent
Tate et al.

(10) Patent No.: US 12,773,608 B2
(45) Date of Patent: Oct. 27, 2026

(54) BRACKET ASSEMBLY FOR MAINTAINING A PISTOL DRILL POSITION WHILE ROTATING THE SCREW IN AN ADJUSTABLE HOOP SYSTEM

(71) Applicants: Keith Tate, Tomball, TX (US); Ryan Tate, Tomball, TX (US); Zach Tate, Tomball, TX (US)

(72) Inventors: Keith Tate, Tomball, TX (US); Ryan Tate, Tomball, TX (US); Zach Tate, Tomball, TX (US)

( * ) Notice: Subject to any disclaimer, the term of this patent is extended or adjusted under 35 U.S.C. 154(b) by 568 days.

(21) Appl. No.: 18/454,896

(22) Filed: Aug. 24, 2023

(65) Prior Publication Data

US 2024/0226684 A1 Jul. 11, 2024

Related U.S. Application Data

(60) Provisional application No. 63/479,047, filed on Jan. 9, 2023.

(51) Int. Cl.
*A63B 63/08* (2006.01)

(52) U.S. Cl.
CPC ..... *A63B 63/083* (2013.01); *A63B 2225/093* (2013.01)

(58) Field of Classification Search
CPC ..... A63B 63/083; A63B 2225/093
See application file for complete search history.

(56) References Cited

U.S. PATENT DOCUMENTS 1,924,811 A 8/1933 Shulz
5,401,015 A 3/1995 Woodall
5,540,429 A 7/1996 Dalebout et al.
6,135,901 A * 10/2000 van Nimwegen ... A63B 63/083 473/483
6,419,597 B1 * 7/2002 van Nimwegen ... A63B 63/083 473/483

(Continued)

FOREIGN PATENT DOCUMENTS

CA 2649950 7/2010
CN 203496975 U 3/2014

(Continued)

OTHER PUBLICATIONS

"Adjustable Basketball Hoop | Hack | Drill Bit"; https://youtu.be/E3okrctFxfw?si=DSdDKgM93AXoSxJ4; Westhead, Michael; Upload Date: Jan. 12, 2020 (Year: 2020).*

*Primary Examiner* — Brian P Wolcott
(74) *Attorney, Agent, or Firm* — The Petruzzi Law Firm; James D. Petruzzi

(57) ABSTRACT

A hinged bracket assembly with a base plate having two L-shaped extended opposite arms and an aperture aligned with a bit in a basketball elevation post, where the bit is engaged with a gear operably engaged to a screw in the elevation post, wherein the opposite arms are sized to provide lateral blocking to the rotation of a pistol drill engaged to an adapter that mates to the bit wherein the drill is capable of turning the adapter to raise and lower the basketball hoop by turning the bit. The arms are made of metal or other rigid material and integrally hinged with the base plate to permit upward and downward movement. The bracket assembly may have magnetic engagement to the elevation post when not in use. The arms may form a pin within a sleeve on the base plate.

20 Claims, 3 Drawing Sheets

(56) References Cited

U.S. PATENT DOCUMENTS

| | | | | |
|---|---|---|---|---|
| 7,393,293 | B2 * | 7/2008 | Guerzini | A63B 63/083 473/483 |
| 8,206,247 | B2 * | 6/2012 | Elpers | A63B 63/083 473/484 |
| 8,348,788 | B2 * | 1/2013 | Nye | A63B 63/083 473/484 |
| 10,857,438 | B2 * | 12/2020 | Givens | A63B 63/083 |
| 10,857,983 | B2 | 12/2020 | Gillin et al. | |
| 10,864,420 | B2 * | 12/2020 | Elpers | A63B 71/023 |
| 11,045,704 | B2 | 6/2021 | Givens | |
| 2002/0094890 | A1 * | 7/2002 | White | A63B 63/083 473/483 |
| 2007/0054759 | A1 * | 3/2007 | Nye | A63B 63/083 473/481 |
| 2008/0039242 | A1 * | 2/2008 | Nye | A63B 63/083 473/483 |
| 2021/0362021 | A1 * | 11/2021 | Reed | A63B 71/023 |
| 2022/0288476 | A1 * | 9/2022 | Le Cunff | A63B 63/083 |

FOREIGN PATENT DOCUMENTS

| | | | | |
|---|---|---|---|---|
| CN | 210021090 | U | 2/2020 | |
| CN | 111346356 | B | 6/2020 | |
| DE | 10347859 | | 4/2005 | |
| DE | 10347859 | A1 * | 4/2005 | B25H 1/0064 |
| EP | 507032 | | 7/1992 | |
| WO | 2011156753 | | 12/2011 | |

* cited by examiner

BRACKET ASSEMBLY FOR MAINTAINING A PISTOL DRILL POSITION WHILE ROTATING THE SCREW IN AN ADJUSTABLE HOOP SYSTEM

CROSS REFERENCE TO RELATED APPLICATIONS

This application claims the benefit of U.S. Provisional Patent Application Ser. No. 63/479,047 filed on Jan. 9, 2023 entitled "Electronic Powered Basketball Height Adjustor System and Bracket" and is incorporated herein by reference.

STATEMENT REGARDING FEDERALLY SPONSORED RESEARCH OR DEVELOPMENT

Not Applicable

FIELD OF THE INVENTION

This invention relates to adjustable basketball hoop systems system, and more particularly to a bracket assembly for maintaining a pistol drill position while rotating the screw in an adjustable hoop system.

BACKGROUND OF THE INVENTION

Extendible basketball hoops with the ability to raise and lower the hoop have been around for some time. Typically, the hoop is raised by pushing up or down on the arms connecting the hoop to the main body of the support and then affixing the hoop in position. In some cases, the hoop is raised or lowered using a hand crank device that engages the main extension post and rotates an internal screw mechanism. These systems are difficult to operate and require hand strength and physical effort to raise and lower the hoop.

There is a need for an assisted hoop system that uses a common pistol drill and adapter and bracket that permits efficient turning of the screw by a user.

A primary advantage of the invention is to provide blocking to the rotational movement of a pistol drill while raising and lowering a basketball hoop.

Another advantage of the invention is to provide a bracket assembly mounted on a basketball hoop system to support a pistol drill.

Yet another advantage of the invention is to provide a bracket assembly with a pass through for a bit engaged to a screw on an elevation post of a basketball hoop system.

In accordance with a preferred embodiment of the invention, there is shown a basketball hoop elevation system bracket assembly having a bracket assembly hingedly attached to an elevation post on a basketball hoop system the assembly having an upward and downward orientation, the assembly has a base plate with two extended opposing arms and an aperture in the base plate for reception of a bit in a basketball elevation post, the aperture is alignable with the bit for engagement to a drill adapter when the base plate is hinged in a downward orientation to the elevation post where the bit is capable of protrusion through the aperture and engaged to a gear operably engaged to a screw in the elevation post for raising and lowering a hoop, and the opposing arms sized to provide lateral blocking to the rotation of a pistol drill engaged to the adapter that mates to the bit wherein the drill is capable of turning the adapter to raise and lower the basketball hoop by turning the bit.

In accordance with another preferred embodiment of the invention, there is shown a basketball hoop elevation system bracket assembly having a bracket assembly hingedly attached to an elevation post on a basketball hoop system the assembly having an upward and downward orientation, the assembly having a base plate formed with two sandwiched sheets, the plate having two extended opposing arms and an aperture in the two sheets in the base plate for reception of a bit in a basketball elevation post, the aperture aligned with the bit for engagement to a pistol drill when the base plate is hinged in a downward orientation to the elevation post where the bit is capable of protrusion through the aperture and engaged to a gear box operably engaged to a screw in the elevation post for raising and lowering a hoop, and the opposing arms sized to provide lateral blocking to the rotation of a pistol drill engaged to the bit wherein the drill is capable of turning the bit to raise and lower the basketball hoop by turning the bit.

In accordance with yet another preferred embodiment of the invention, there is shown a basketball hoop elevation system bracket assembly having a hinged bracket assembly having a base plate with two opposing L-shaped tubular members and an aperture in the base plate for reception of a bit in a basketball elevation post gear box, the aperture aligned with the bit when the base plate is hinged in a downward position to the elevation post where the bit is capable of protrusion through the aperture for engagement with the gear box operably engaged to a screw in the elevation post, the opposing arms sized to provide lateral blocking to the rotation of a pistol drill engaged to an adapter that mates to the bit wherein the drill is capable of turning the adapter to raise and lower the basketball hoop by turning the bit.

In accordance with yet another preferred embodiment of the invention, there is shown a basketball hoop elevation system bracket assembly having a hinged bracket assembly having a base plate with two opposing L-shaped tubular members and an aperture in the base plate for reception of a bit in a basketball elevation post gear box, the aperture aligned with the bit when the base plate is hinged in a downward position to the elevation post where the bit is capable of protrusion through the aperture for engagement with the gear box operably engaged to a screw in the elevation post, the opposing arms sized to provide lateral blocking to the rotation of a pistol drill engaged to an adapter that mates to the bit wherein the drill is capable of turning the adapter to raise and lower the basketball hoop by turning the bit.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for later filed claims and as a representative basis for teaching one skilled in the art to employ the present invention in virtually any appropriately detailed system, structure, or manner.

Figure 1A:
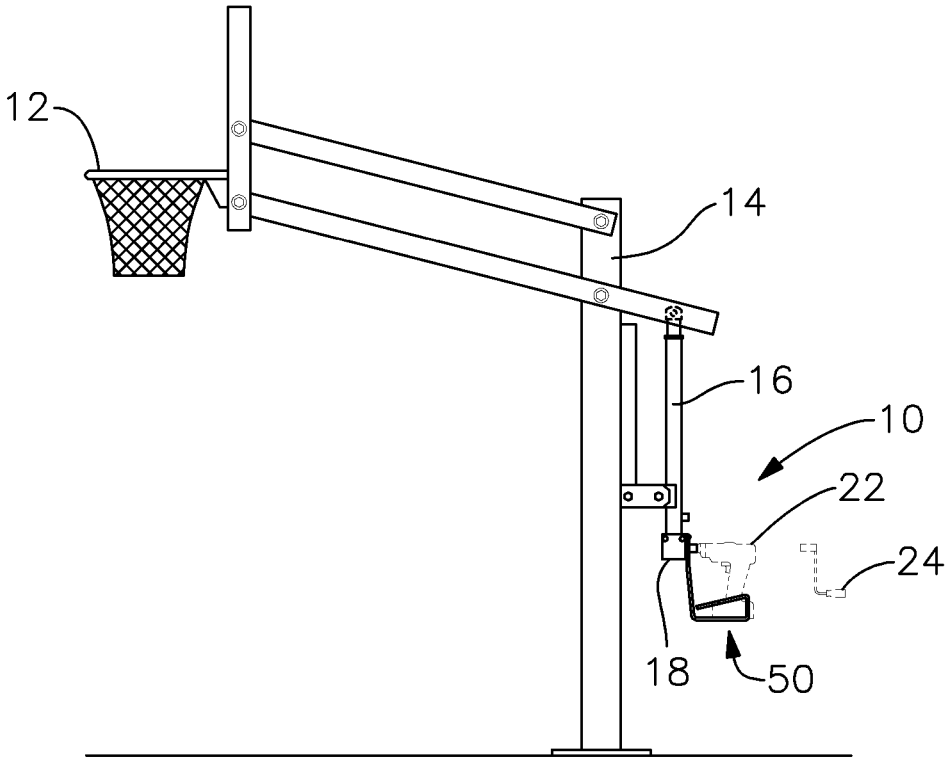
FIG. 1A illustrates a raisable basketball hoop with pistol drill driving apparatus and bracket for engagement to the elevation post in a raised position according to a preferred embodiment of the invention.

Turning now to FIG. 1A, there is shown a basketball hoop 12 capable of being raised and lowered using a gearbox 18 driven by standard pistol drill 22 or by manual crank 24. Pistol drill 22 is engaged to a bit 56 shown in FIG. 3 by way of adapter 40 also shown in FIG. 2. The actuator is engaged to post 16 connected to a gear that in turn drives a second gear for moving a main screw in the elevation post. The gears typically are made of hardened steel and are maintained in a grease filled enclosure. Post 16 is operably connected to main post 14 which in turn is operably connected to hoop 12.

Figure 1B:
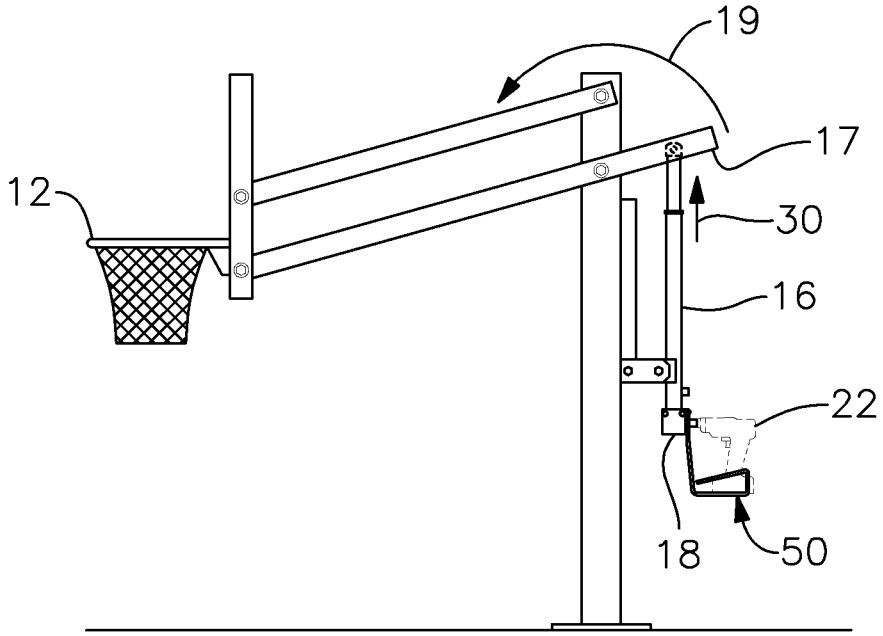
FIG. 1B illustrates a raisable basketball hoop with pistol drill driving apparatus and bracket for engagement to the elevation post in lowered position according to a preferred embodiment of the invention.

FIG. 1B shows basketball hoop 12 in a lowered position achieved by operating pistol drill 22 to move post 16 upward in direction 30 upon arm 17 which in turn causes basketball hoop 12 to move downward as arm 17 moves in direction 19.

FIGS. 1A and 1B also who bracket 20 connected to gear box 18 for providing stability to pistol drill 22 as more fully described below in FIGS. 4 and 5.

Bracket assembly 50 is affixed to the elevation post 16 that can be moved upward out of the way when not in use, and then lowered to support the sides of the drill to maintain its position as the drill operates to inhibit rotation of the drill due to the torque being applied to the drill adapter. This maintains the drill in a proper orientation as the motor rotates the adapter to inhibit excess motion and provide support to the operator.

Figure 2:
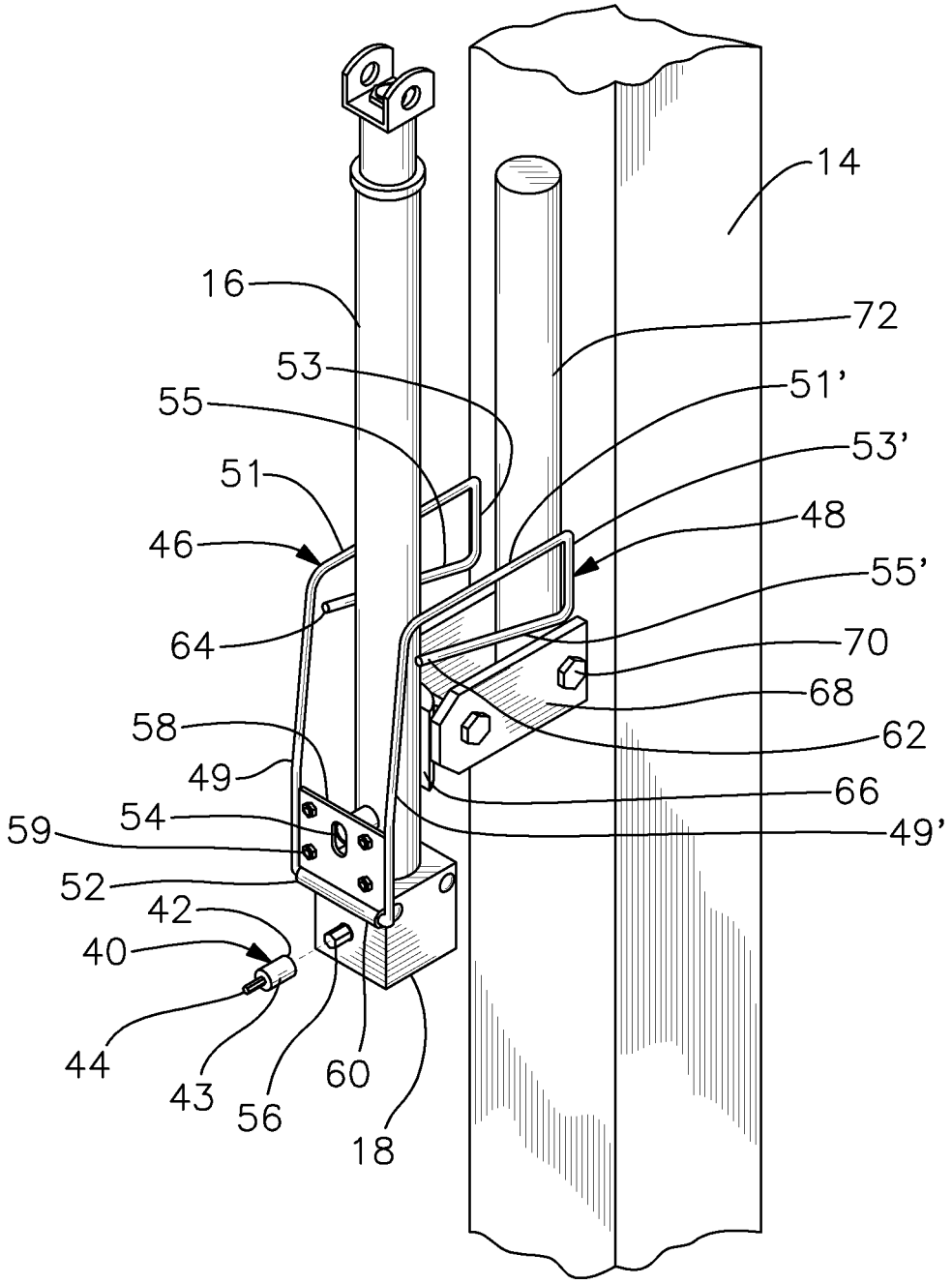
FIG. 2 illustrates a perspective view of a bracket in operation and in an upward position and attached to the elevation post for stabilizing a pistol drill according to a preferred embodiment of the invention.
Figure 3:
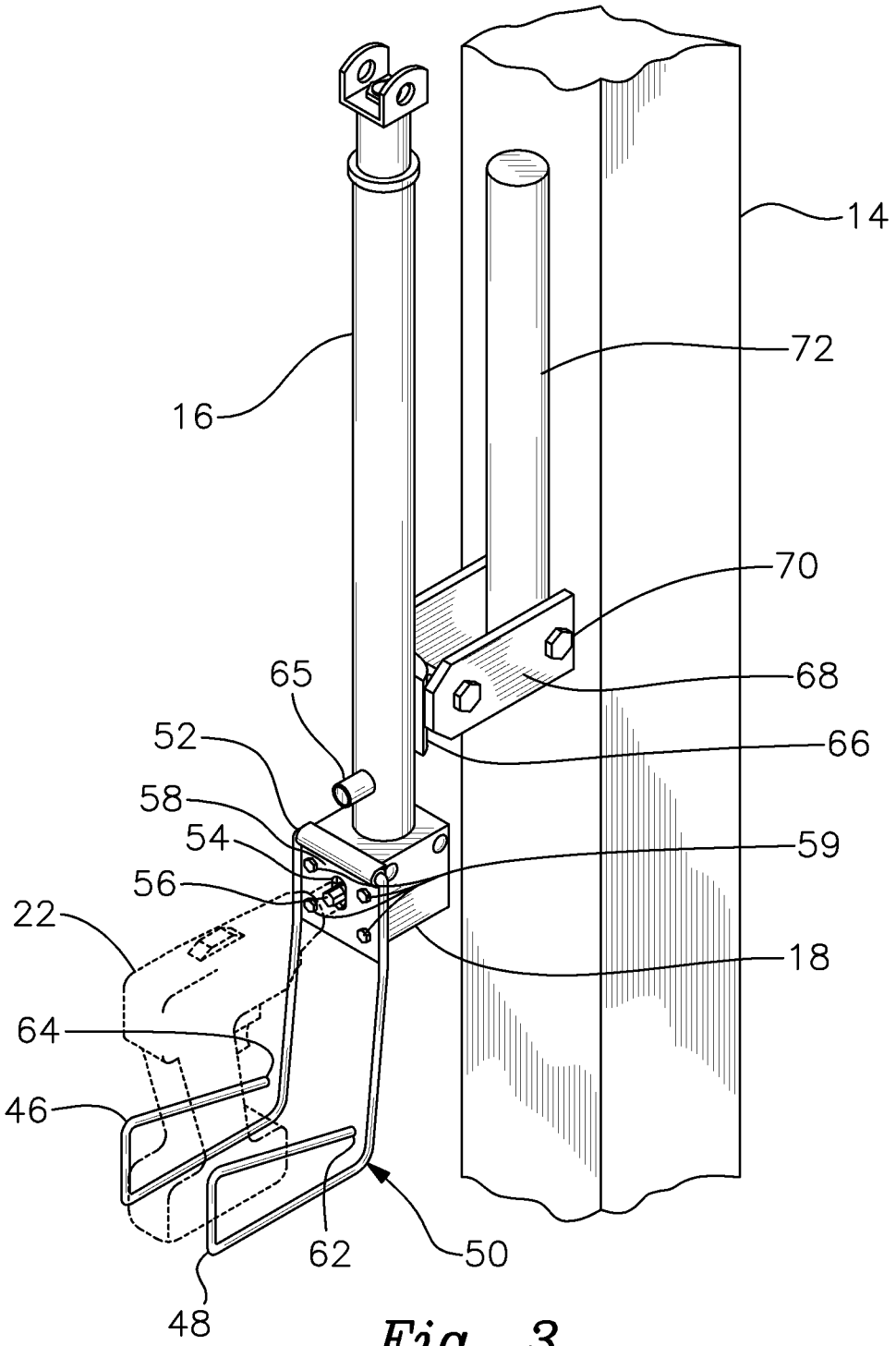
FIG. 3 illustrates a perspective view of a bracket and in a downward position and attached to the elevation post for stabilizing a pistol drill, bit for engagement of drill adapter and adapter according to a preferred embodiment of the invention.

Turning to FIGS. 2 and 3, there is shown a perspective view of a standard basketball mounting post 14 fixedly attached to post 72 with bolt 70 through side plate 68 which is in turn fixedly attached to elevation post 16 by facing 66 welded to post 16. Prior art basketball hoop systems utilize a screw engaged to gears in gear box 18 that upon rotation of the gears raise and lower the screw which in turn raise and lower the basketball hoop. Gear box 18 is operably engaged to bit 56 through aperture 54 for attachment to adapter 44 that is turned by pistol drill 22. Adapter 40 having proximal end 44 for engagement to a pistol drill, a body 43 with a hollowed interior 42 for engagement to bit 56 in gear box 18. Hollow interior 42 may be of any of a configurations including cross sectional shapes such as hexagonal, triangular, star or other cross-sectional shapes for mating engagement to bit 56. Proximal end 44 is a standard configuration for engagement to typical pistol drill chucks.

A dual L-shaped bracket assembly 50 is hingedly attached to the base of the elevation post 16 at gear box 18 having header or base plate 58 with aperture 54. Header or base plate 58 may be a single piece of metal or a sandwiched configuration of two plates having an opening bolted together with bolts 59 forming aperture 54. Hinge pin 52, inserted into sleeve 60, provides pivoting movement of bracket assembly 50 to raise and lower when in use. Hinge pin 52 may be formed as extensions of portions 49 and 49' that meet in the middle of sleeve 60, or alternatively hinge pin 52 is a single solid tubular member that is welded to the ends of portions 49 and 49' for stable engagement within sleeve 60.

Bracket assembly 50 has two extensions 46 and 48 on header plate 58 that each form an L shape terminating in ends 62 and 64 to provide guardrails for the drill to inhibit sideways movement as the drill is engaged. Extensions 46 and 48 may be formed of tubular or solid metal into the desired shape. Alternatively, extensions 46 and 48 may be made of other materials included blow molded plastic or other synthetic materials. Extensions 46 and 48 may be rods of metal or tubular members.

Each extension 46 and 48 may be formed having a first portion 49 and 49', respectively, and a second portion 51 and 51', respectively, forming a roughly 75-90 degree angle with third portion 53 and 53', respectively, roughly parallel to portions 49 and 49' that makes a second approximately 75-90 degree turn toward first portions 49 and 49', and fourth portion 55 and 55', respectively, roughly parallel to portions 51 and 51', forming a roughly 75-90 degree angle, to form an open loop terminating in end 64 or 62 respectively. Each opposite arm is similarly configured to form am L-shaped arm for two-sided blocking to a pistol drill.

Pistol drill 22 is engaged to bit 56 for stable rotational movement of adapter 40 that in turn operates the screw in post 16. When using a pistol drill, to turn the elevation post screw, torque may be high in operation which would cause the drill to rotate or shake in the hand of an operator and make using the device harder for operators. Bracket assembly 50 prevents rotational movement of the drill caused by the torque on the elevation post gears and the adapter by blocking rotational movement of the handle of the pistol drill when in rotational operation.

Alternative embodiments of L-shaped extensions 46 and 48 may include an L-shaped plate or triangular plate that forms a closed "L" type shape hingedly attached the base plate so long as the arms provide lateral blocking to the pistol drill when in operation.

FIG. 2 shows bracket 50 rotated upward on hinge pin 52 when not in use. Adapter 40 having proximal end 44 for engagement of pistol drill 22 is shown in exploded position from bit 56. Bit 56 is capable of protruding from aperture 54 in header plate 58 when bracket assembly 50 is in the down position for operation. The swinging bracket or elevation post or both may include a magnet so that the bracket is removably connected to the elevation post when raised to permit manual cranking if desired. In one embodiment, magnet 65 is shown extended from elevation post 16 in FIG. 3 that engages header plate 58 when in an upward position.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the later allowed claims.

The invention claimed is:

1. A basketball hoop elevation system comprising:

a. a bracket assembly comprising a base plate and a hinge assembly including a hinge pin received within a sleeve, the hinge assembly being configured to pivotally attach the base plate to an elevation post on a basketball hoop system such that the bracket assembly is moveable between an upward orientation and a downward orientation;

b. the base plate having two extended opposing arms extending from the base plate as rigid L-shaped tubular members arranged in spaced parallel relation and an aperture in the base plate;

c. the aperture being positioned and dimensioned to align with a bit for engagement of the bit with a drill adapter when the base plate is in a downward orientation relative to the elevation post where the bit is capable of protrusion through the aperture and the bit is engaged to a gear operably engaged to a screw in the elevation post for raising and lowering a hoop; and d. the two extended opposing arms being sized and positioned to receive a body portion of a pistol drill between the opposing arms to provide lateral blocking to the pistol drill when engaged to the adapter that mates to the bit wherein the drill is capable of turning the adapter to raise and lower the basketball hoop by turning the bit.

2. The basketball hoop elevation system as claimed in claim 1 wherein the hinge assembly includes a hinge pin disposed within a sleeve operably connected to the base plate.

3. The basketball hoop elevation system as claimed in claim 1 wherein the two extended opposing arms are L-shaped tubular members extending from the base plate.

4. The basketball hoop elevation system as claimed in claim 1 further comprising a magnet disposed on the base plate or the elevation post for magnetic engagement therebetween.

5. The basketball hoop elevation system as claimed in claim 3 wherein the two extended opposing arms are formed with an open loop configuration defined by multiple angled portions.

6. The basketball hoop elevation system as claimed in claim 1 wherein the two extended opposing arms include end portions that engage with each other to define the hinge pin in a sleeve on the base plate.

7. The basketball hoop elevation system as claimed in claim 1 further comprising the two extended opposing arms being formed of hardened metal material.

8. A basketball hoop elevation system comprising:

a. a bracket assembly comprising a base plate and a hinge assembly including a hinge pin received within a sleeve, the hinge assembly configured to pivotally attach the base plate to an elevation post on a basketball hoop system such that the bracket assembly is moveable between an upward and downward orientation;

b. the bracket assembly having a base plate formed with two sandwiched sheets, the base plate having two extended opposing arms comprising rigid L-shaped members arranged in spaced relation and an aperture through the two sandwiched sheets for reception of a bit in the elevation post;

c. the aperture being positioned and configured to align with the bit for engagement to a pistol drill when the base plate is in a downward orientation relative to the elevation post wherein the bit is capable of protrusion through the aperture and engaged to a gear box operably engaged to a screw in the elevation post for raising and lowering a hoop; and d. the two extended opposing arms being sized and positioned to received a body portion of a pistol drill between the opposing arms to provide lateral blocking to rotation of the pistol drill engaged to the bit wherein the drill is capable of turning the bit to raise and lower the basketball hoop by turning the bit.

9. The basketball hoop elevation system as claimed in claim 8 wherein the opposing arms are L-shaped with an open loop defined by multiple angled segments.

10. The basketball hoop elevation system as claimed in claim 8 wherein the opposing arms are generally parallel to each other and extend from the base plate in a spaced apart configuration.

11. The basketball hoop elevation system claimed in claim 8 wherein the opposing arms are welded to the base plate.

12. The basketball hoop elevation system claimed in claim 8 wherein the bracket assembly has a magnet disposed on the base plate for mating to the elevation post.

13. The basketball hoop elevation system as claimed in claim 8 wherein the two opposing arms are sized to bracket opposing sides of a pistol drill to inhibit rotational movement of the pistol during operation.

14. The basketball hoop elevation system as claimed in claim 8 wherein the opposing arms are generally triangular metal sheets.

15. A basketball hoop elevation system comprising:

a. a hinged bracket assembly comprising a base plate and a hinge assembly including a hinge pin received within a sleeve configured to pivotally attach the base plate to an elevation post, the base plate having two opposing L-shaped tubular members extending from the base plate in spaced relation and an aperture in the base plate for reception of a bit in a basketball elevation post gear box;

b. the aperture being positioned and configured to align with the bit when the base plate is in a downward position relative to the elevation post gear box wherein the bit is capable of protrusion through the aperture for engagement with the gear box operably engaged to a screw in the elevation post; and c. the opposing L-shaped tubular members being sized and positioned to receive a body portion of a pistol drill between the opposing arms to provide lateral blocking to rotation of a pistol drill engaged to an adapter that mates to the bit wherein the drill is capable of turning the adapter to raise and lower a basketball hoop by turning the bit.

16. The basketball hoop elevation system ly as claimed in claim 15 wherein the opposing arms are tubular and comprise hollow L-shaped members configured to receive and laterally constrain a body portion of the pistol drill.

17. The basketball hoop elevation system as claimed in claim 15 further comprising a magnet disposed on the base plate or elevation post for magnetic engagement therebetween.

18. The basketball hoop elevation system as claimed in claim 15 wherein the base plate is formed with two sandwiched sheets having an aligned aperture in each sheet.

19. The basketball hoop elevation system as claimed in claim 15 further comprising a magnet on the elevation post for engagement between the hinged bracket assembly and the elevation post.

20. The basketball hoop elevation system as claimed in claim 15 wherein ends of the opposing arms form a hinge pin inside a sleeve on teh hinged bracket assembly.

* * * * *